US009000890B1

(12) United States Patent
Hart

(10) Patent No.: US 9,000,890 B1
(45) **Date of Patent: *Apr. 7, 2015**

(54) PUZZLE BOX METHOD, SYSTEM, AND COMPUTER PROGRAM PRODUCT

(71) Applicant: Mikal Neal Hart, Austin, TX (US)

(72) Inventor: Mikal Neal Hart, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/933,696

(22) Filed: Jul. 2, 2013

Related U.S. Application Data

(63) Continuation of application No. 12/903,184, filed on Oct. 12, 2010, now Pat. No. 8,508,335.

(60) Provisional application No. 61/391,516, filed on Oct. 8, 2010, provisional application No. 61/391,635, filed on Oct. 9, 2010.

(51) Int. Cl.
*G08C 19/00* (2006.01)
*G07C 9/00* (2006.01)

(52) U.S. Cl.
CPC ..... *G07C 9/00896* (2013.01)

(58) Field of Classification Search
USPC ..... 340/5.7, 5.71, 5.72, 5.73, 539.23, 994; 70/63, 161, 162, 267
See application file for complete search history.

(56) References Cited

U.S. PATENT DOCUMENTS 5,124,696 A * 6/1992 Bosley ..... 340/5.73
5,648,763 A * 7/1997 Long ..... 340/5.73
7,132,925 B2 11/2006 Johnson
7,498,938 B2 3/2009 Ulrich
7,681,422 B2 3/2010 Tonaltzin
2003/0090364 A1 5/2003 Cardinale
2004/0108938 A1 6/2004 Entrekin
2005/0134429 A1 6/2005 Bates
2008/0191867 A1 * 8/2008 Markovich ..... 340/539.13
2009/0250295 A1 * 10/2009 Laws ..... 182/223

OTHER PUBLICATIONS

"Latches-The Mechanical Kind," Arduino: Forum topic, Oct. 31, 2008, http://www.arduino.cc/cgi-bin/yabb2/YaBB.pl?num=1225421394/0.
"Electromagnetic Locks," Ingersll Rand Security Technologies website, http://w3.securitytechnologies.com/Products/system_components/electromagnetic_locks/Pages/default.aspx.
Schlage Electromagnetic Locks brochure, Feb. 2011.
Electronic Dead Bolt Door Lock, DealExtreme website, http://www.dealextreme.com/p/electronic-dead-bolt-door-lock-6372.
Atmega 168/V microcontroller manual, p. 306, section 29.4, Clock Characteristcis, May 2011.

* cited by examiner

*Primary Examiner* — Nabil Syed
(74) *Attorney, Agent, or Firm* — Anthony V. S. England

(57) ABSTRACT

A box contains a motorized latch for locking the lid of the box and a GPS device for determining a geo-location. The box also contains an electronic controller, which is programmed with a predetermined geo-location and is programmed for driving the latch and a display. The controller is programmed to cause the display to show distances to the predetermined geo-location in response to actuations of a push button mounted on the box. The controller is also responsive to respective current locations. The controller is programmed to disengage the latch If a distance indicated by the GPS device to the predetermined geo-location is less than a predetermined distance, revealing whatever treasures have been hidden inside the box.

20 Claims, 9 Drawing Sheets

PUZZLE BOX METHOD, SYSTEM, AND COMPUTER PROGRAM PRODUCT

This is a continuation of, and hereby claims the benefit of the priority date of, application Ser. No. 12/903,184, filed Oct. 12, 2010 and provisional applications 61/391,635, filed Oct. 9, 2010, and 61/391,516, filed Oct. 8, 2010, all of which are hereby incorporated herein by reference.

System 100 provides a reverse geocache puzzle box 104 that may be given to a user in a locked-shut condition. (Note: "Reverse Geocache" is a trademark of Mikal Hart.) System 100 maintains box 104 in this locked-shut condition unless box 104 is physically located at a predetermined geo-location. In the well-known sport of geocaching, a container is initially located at a predetermined geo-location, so that a user may then find the location and the container and may thereby access contents of the found container. In contrast, in an embodiment of the present invention, system 100 provides a box 104 that the user may carry in order to find a predetermined geo-location, as indicated by mobile box 104 itself, so that contents of carried box 104 can be accessed at that location. Further, and also in contrast to geocaching, the geo-location may be undisclosed to the user. Still further, according to an embodiment of the invention, system 100 may limit information to the user about its very operation, providing a still further puzzle for the user, i.e., the puzzle of discovering even the mere fact that box 104 will unlock at an undisclosed location.

Methods and computer program products providing aspects of the above-summarized features are also described and claimed herein.

BRIEF DESCRIPTION OF DRAWINGS

Novel features of this disclosure are set forth in the appended claims. These features, as well as advantages and a preferred mode of use thereof, will best be understood by reference to the following Detailed Description of one or more illustrative embodiments of the invention, particularly when read in conjunction with the accompanying figures, which are briefly described as follows:

DETAILED DESCRIPTION

Figure 1A:
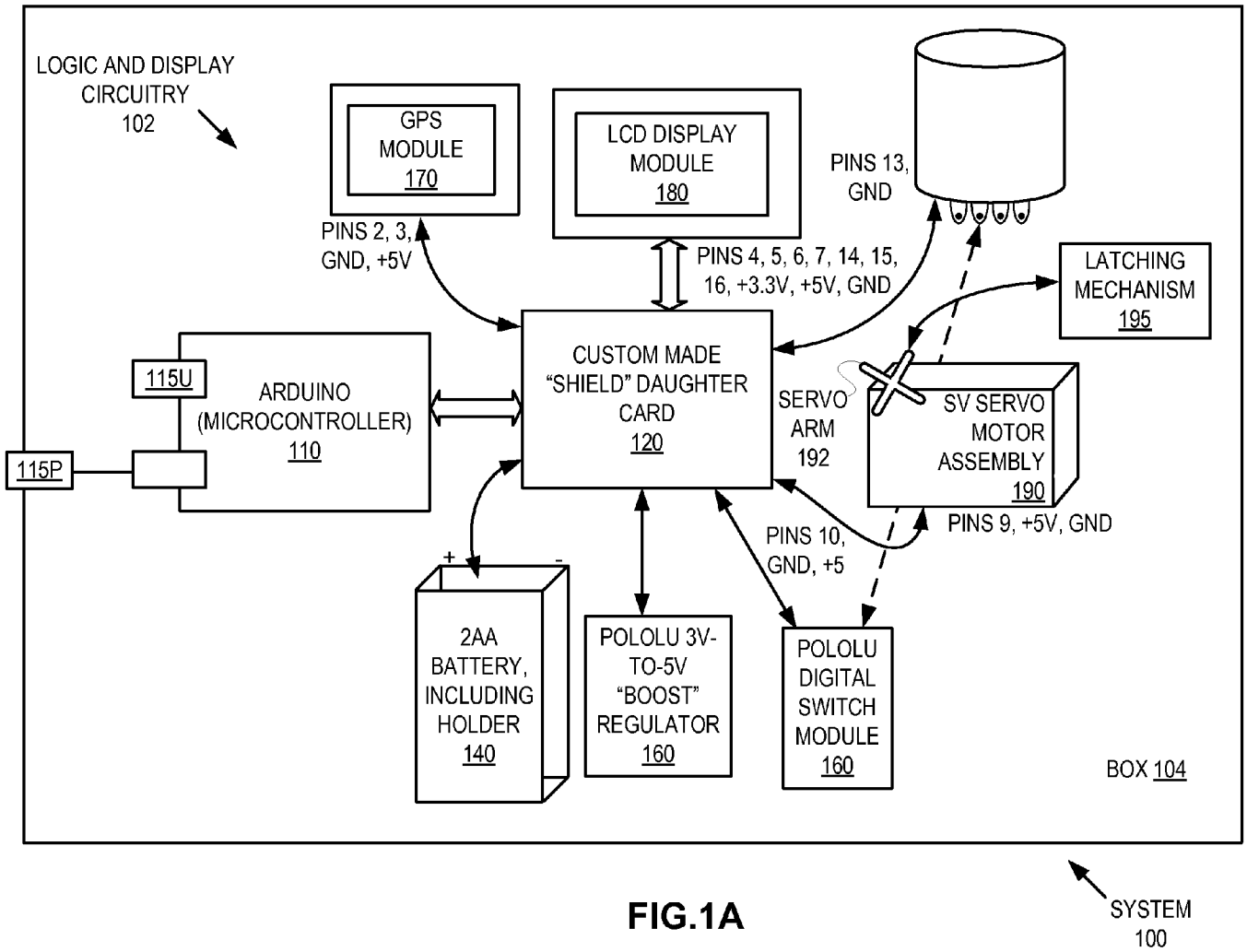
FIG. 1A is a block diagram of a puzzle box system, according to an embodiment of the invention.

Referring to FIG. 1A, a block diagram of system 100 is shown, according to an embodiment of the invention. A user (also referred to herein as "custodian") may be presented with system 100 by an owner or other administrator of system 100, which includes locked box 104 and contained circuitry 102. Circuitry 102 is configured and initialized to unlock box 104 at a predetermined geo-location. However, in order for system 100 to provide a puzzle to the user, the user may receive no operating instructions, according to an embodiment. It is clear from looking at the exterior of box 104 that the box houses a display 180, which is initially off, and a switch, e.g., pushbutton 130, which is accessible to the user for actuation. This may lead the user to actuate pushbutton 130. If the user is indoors in a location such that GPS module 170 of circuitry 102 cannot obtain a global positioning system ("GPS") signal, then controller 110 causes display 180 to sequentially display the following, one line at a time, responsive to the user actuating pushbutton 130:

"This is attempt 1 of 50"
"No signal acquired . . .
Powering off . . . "

If the user then deduces that a signal might be acquired outside, or merely randomly happens to goes actuate pushbutton 130 when outside, then if system 100 at that time is 391 km from its pre-programmed geo-location, controller 110 causes display 180 to sequentially display the following, one line at a time:

"This is attempt 2 of 50
Distance 391 km
Access Denied
Powering off . . . "

If the user then immediately retries at the same location, controller 110 causes display 180 to sequentially display the following, one line at a time, which may tend to focus the user's attention on an indication that attempts are limited to 50:

"This is attempt 3 of 50
Distance 391 km
Access Denied
Powering off . . . "

The user may also then deduce that the distance is an issue and may retry after carrying system 100 to a location 226 km from the pre-programmed geo-location, whereupon controller 110 causes display 180 to sequentially display the following, one line at a time:

"This is attempt 4 of 50
Distance 226 km
Access Denied
Powering off . . . "

Eventually the user may deduce the predetermined geo-location through trial and error, which includes carrying the box to different locations and repeating the above sequence each time. After carrying box 104 to the pre-programmed geo-location, within a pre-programmed margin of error, controller 110 causes display 180 to display the following responsive to actuation of pushbutton 130:

"Access Granted!"

The custodian's experience depends greatly on the owner/administrator's choice of target location and box 104 contents. For a maximal experience, the owner/administrator chooses carefully so that the contents and the target location have a connection to the custodian, e.g., correspond to a past event of emotional significance in the life of the custodian. Ideally, the connection for the custodian is also a connection shared by the owner/administrator. For example: A young woman (owner) presents her father (custodian) with a box. The box is programmed to open at a ski resort which was the site of many happy times for the pair. Upon solving the puzzle, the father finds inside box 104 old photos of the two of them skiing together and lift tickets.

Box 104 contains logic and display circuitry 102 and has a lid (not shown in FIG. 1A). Latching mechanism 195 is mounted inside box 104 and is configured to latch the lid shut or release it via servo motor assembly 190. With the lid latched, box 104 is sealed shut, so that circuitry 102 is inaccessible, except that LCD display module 180 of circuitry 102 is mounted in box 104 so as to be externally viewable and pushbutton 130 is mounted in box 104 so as to be externally accessible to the extent that a user can actuate it. Batteries 140 are locked inside box 104 and can't be replaced without breaking into box 104 if they run down—not while the puzzle provided by system 100 remains unsolved, anyway—so it's important to conserve power.

Accordingly, for an embodiment of the invention controller 110 is configured to power up for a "session" responsive to user actuation of a pushbutton 130 mounted on box 104 and accessible from the outside, wherein controller 110 is initialized with a predetermined session time limit, such as 2-3 minutes, and is configured to countdown to the session time limit and power off at the end of the session. (Controller 110 may be such as an Arduino microcontroller, which is available from SparkFun Electronics, 6175 Longbow Drive, Suite 200, Boulder, Colo. 80301. Arduino microcontrollers are programmable in an open source language extensible by use of C++ libraries.)

Figure 1B:
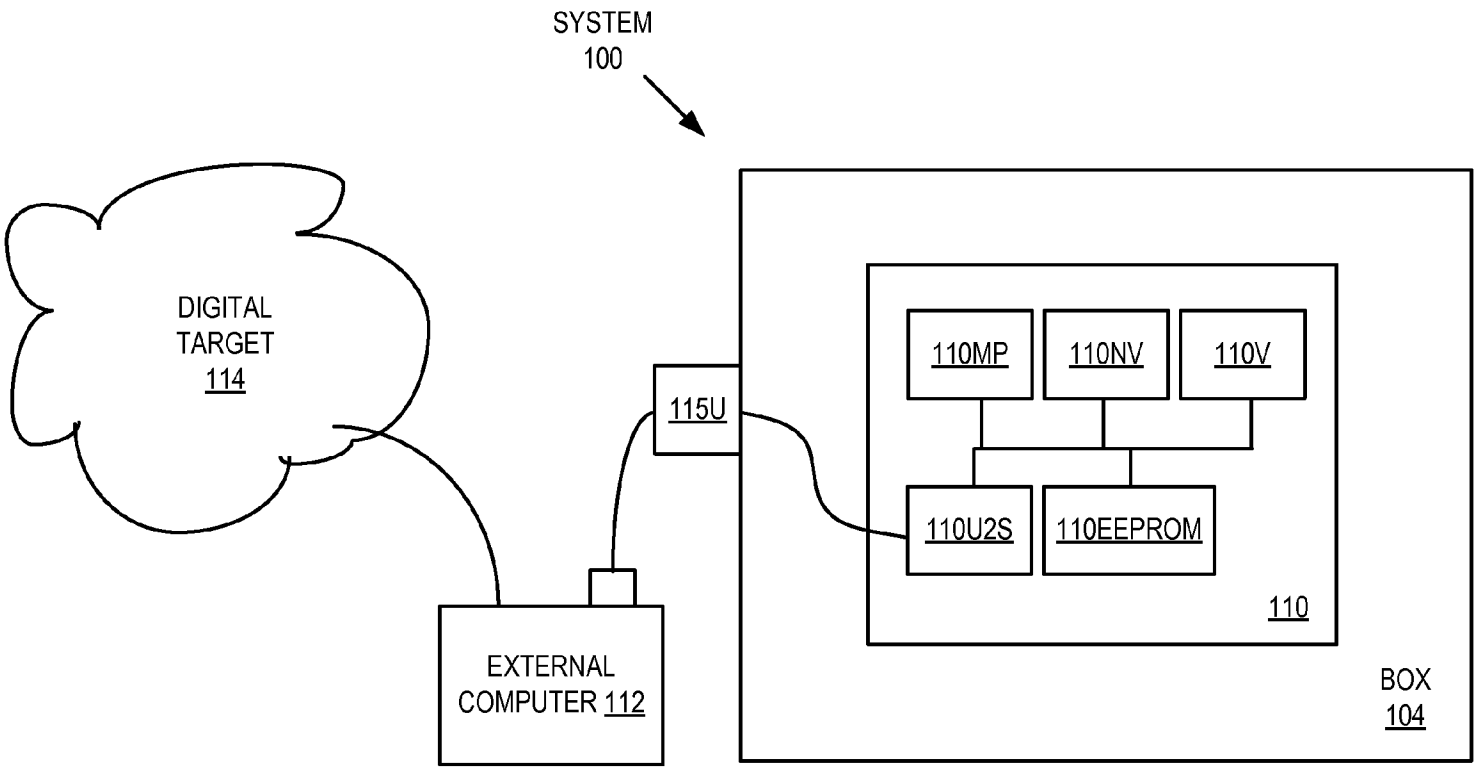
FIG. 1B is block diagram of a puzzle box system connected to an external computer system, which is connected to a digital target, according to an embodiment of the invention.

Referring now also to FIG. 1B, an Arduino controller 110 includes a microprocessor 110MP, an internal clock (not shown), 2K RAM 110V, 32K non-volatile ROM 110 NV, and even 512 non-volatile EEPROM space 110EEPROM, in an embodiment. Pin assignments shown next to respective components of circuitry 102 in FIG. 1A indicate the controller 110 pins to which those respective components are connected. Controller 110 executes a one or more programs described in the Appendix herein, which are stored in non-volatile ROM. This includes a quest routine also described herein below regarding flowchart FIG. 2, blocks 204 through 232, and, in an embodiment, a back door access and reset routine, also described herein below regarding flowchart FIG. 2, blocks 234 through 240. During execution of the quest program, controller 110 may store data in the non-volatile EEPROM, such as how many times button 130 has been pushed, for example. EEPROM permits completely shutting down power to controller 110 without loss of data acquired during execution of the quest program. The ROM may be programmed by an external computer by communication via connector 115U.

Furthermore, controller 110 is configured to increment a session counter responsive to each such actuation, wherein controller 110 is initialized with a predetermined session counter limit, such as 50, for example, and configured to allow the user only that many sessions in the user's attempts to discover the box's secret. Consequently, the active lifespan of batteries 140 need be no more than about 150 minutes. With other embodiments with longer "session times" or more or fewer button presses allowed, this number might grow or shrink. But the point is the battery requirements are always bounded. Between sessions, logic and display circuitry 102 draw virtually no power, so batteries 140 should last idle for years.

In one embodiment, this power conservation may be enabled by configuring system with pushbutton 130 coupled (via daughter card 120) to a digital switch module 160 mounted on card 120. Module 160, which is available from Pololu Corporation, 3095 E. Patrick Ln. #12, Las Vegas, Nev. 89120, is controllable to completely turn off the rest of circuitry 102 off through software. That is, when the user pushes pushbutton 130, it latches and distributes power from batteries 140 to the rest of circuitry 102. When controller 110 ends a session, either because it can't find a GPS signal or it's not close enough to the pre-programmed geo-location (also referred to herein as "target"), or it is close enough to the target and has unlocked the latch, then controller 110 asserts a high signal on a power control pin of module 160, as a shut down indication. Module 160 responsively cuts power off to all the rest of circuitry 102.

To be clear, in an embodiment module 160 cuts power to microcontroller 110 completely off responsive to the shut down indication, so that even the clock of microcontroller 110 is off. In this "off" state, switch module 160 draws just 0.01 micro amps and all other components of circuitry 102 draw none, including microcontroller 110, GPS module 170, LCD module 180, etc. In spite of microcontroller 110 being completely turned off, system 100, nevertheless, keeps track of time by controller 110 querying GPS module 170 for the current time, which module 170 obtains from one or more remote satellites.

In the off state, switch module 160 awaits actuation of pushbutton 130, which causes assertion of a signal (from batteries 140, of course) on a power control pin of module 160, as a power up indication. Responsive to the power up indication, module 160 switches power back on to microcontroller 110 and other components of circuitry 102. In another embodiment, module 160 may cause microcontroller 110 to merely change to a reduced power consumption state responsive to the so-called shut down indication, and may cause microcontroller to return to a full power consumption state responsive to the power up indication.

In an embodiment, voltage boost regulator circuit 150, also available from Pololu, is included in system 100 to enable nominally 5V electronic components to be driven by batteries 140 providing only 3.0V. This is important because circuitry 102 must be as small as possible to discreetly fit in a relatively tiny box 104.

GPS module 170 may be an EM-406A module, such as available from Sparkfun Electronics. When active, GPS module 170 generates a stream of position data according to a well-known protocol, such as a protocol described in one or more publications by the National Marine Electronics Association. This stream enters a "soft" serial port of controller 110 via daughter card 120 (also referred to herein as a "shield") managed by a NewSoftSerial library disclosed herein. Controller 110 parses position data into latitude/longitude using TinyGPS, a library disclosed herein. If GPS module 170 is getting a good fix, it can determine its location within 10 meters. Through a formula programmed in controller 110, circuitry 102 uses this location information from GPS module 170 to calculate how close it is to the target.

Display 180 may be an HD44780-compatible device, such as available from Sparkfun Electronics, controlled by the Arduino LiquidCrystal library, which is disclosed herein. Controller 110 is configured to cause flashing and scrolling on display 180, according to a program disclosed herein, which is supported by libraries. These are carefully structured so as not to block the all-important serial input stream coming from the GPS module 170.

Internal latch 195 is operated by servo assembly 190, which is available from Hitec RCD, 12115 Paine Street, Poway, Calif. 92064. In an embodiment, latch 195 includes three eyelet screws and a dowel (not shown), which is the size of a typical chopstick in one or more embodiments. One end of the dowel is attached to servo arm 192 of assembly 190, and the other threaded through the two eyelet screws mounted into the bottom of box 104. Servo 190 operates in one of two positions—"open" and "closed." When controller 110 instructs it to close, servo 190 drives the dowel laterally through the third eyelet screw hanging from the box lid, which latches box 104. Once the puzzle is finally solved, which includes moving system 100 to the target, controller 110 sends a signal to servo 190 causing it to pull the dowel back, unlatching the lid of box 104, so that the user can open box 104 and access its contents.

Figure 4:
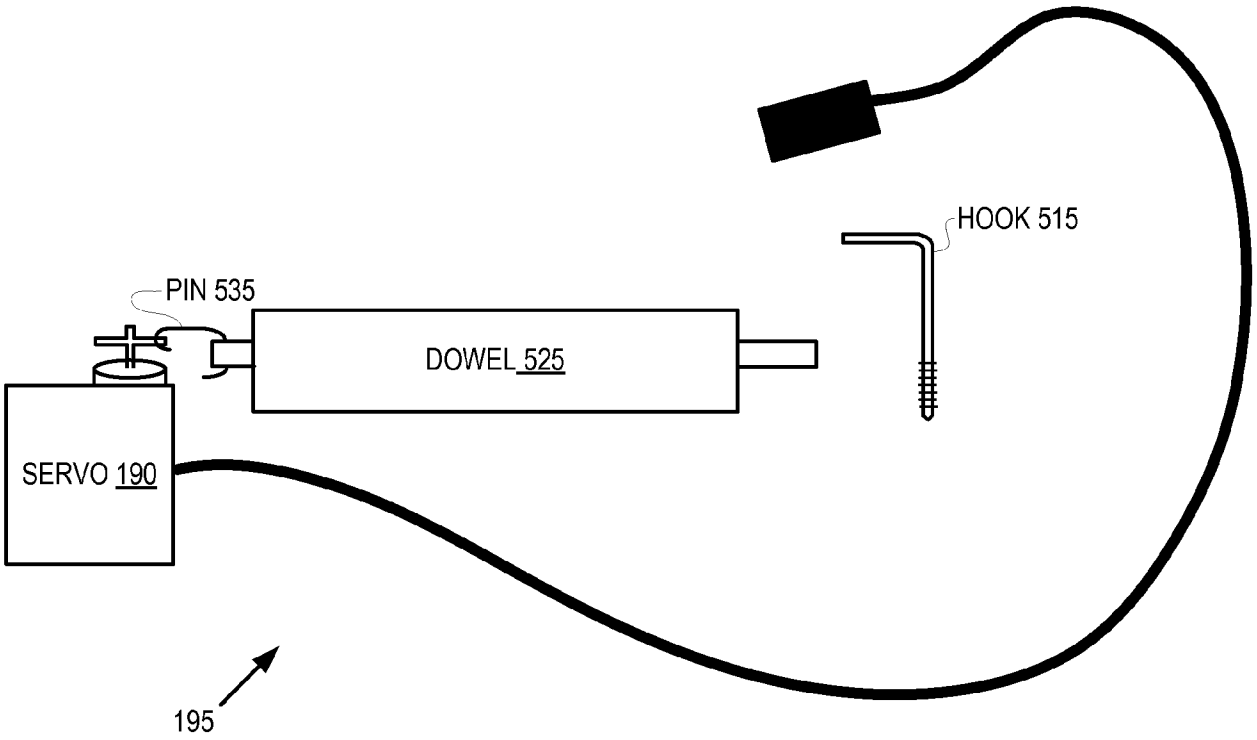
FIG. 4 illustrates a latch mechanism components and servo prior to installation, according to an embodiment of the invention.

Referring now to FIG. 4, portions of latch assembly 195 are shown unassembled and uninstalled, according to an embodiment, including servo 190, dowel 525, pin 535 and hook 515. Installation and operation of these components are described in the following, according to an embodiment.

Figure 5A:
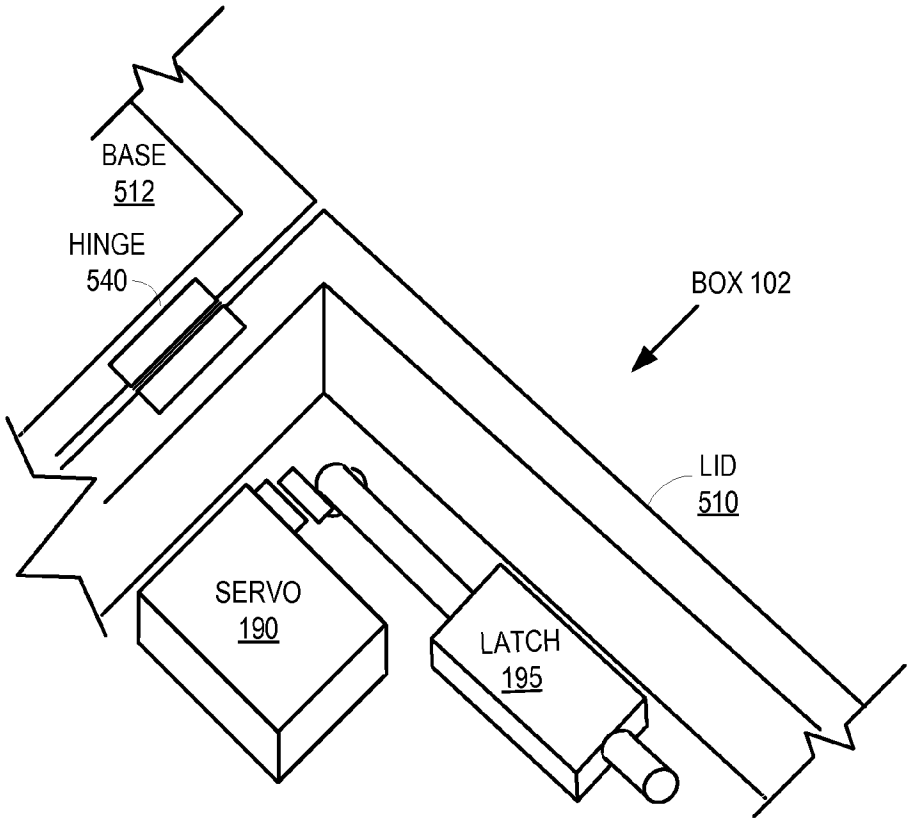
FIGS. 5A and 5B illustrate a latch mechanism and servo, as installed, according to an embodiment of the invention.
Figure 5B:
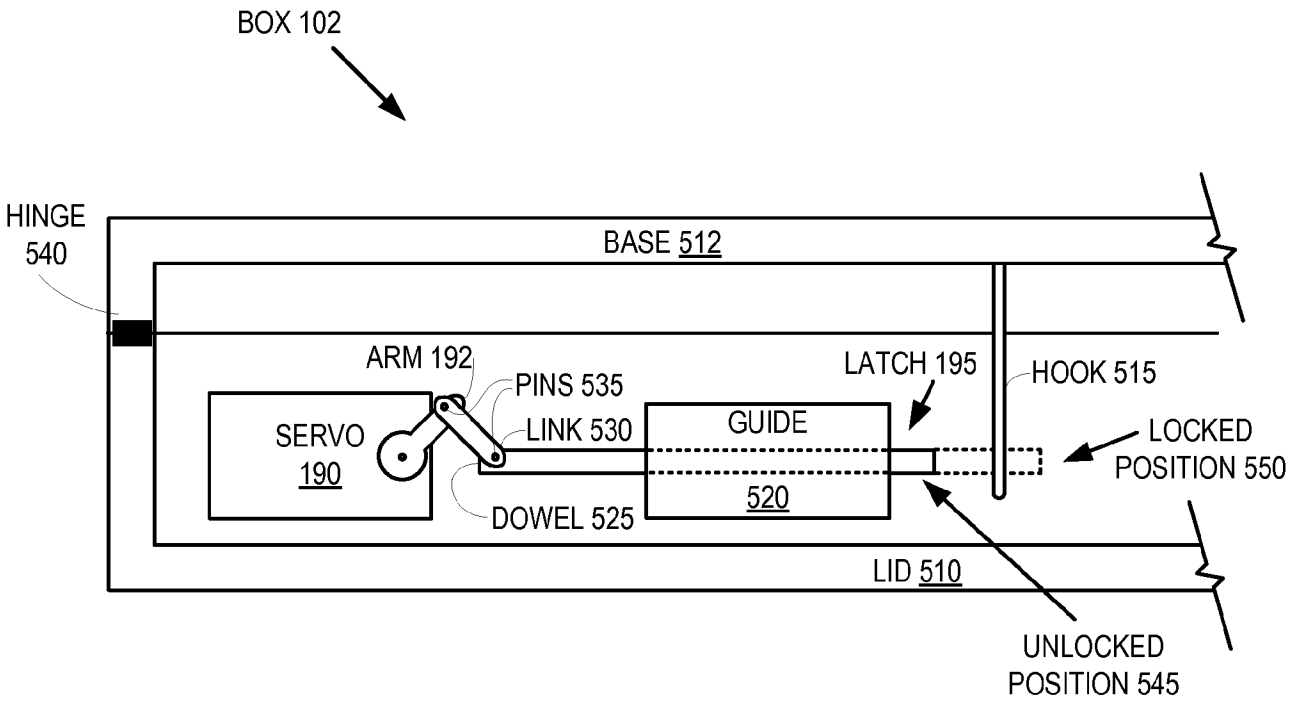

Referring now to FIGS. 5A and 5B, the inside of box 104 is shown, with box 104 sitting upside down on its lid 510, according to an embodiment. For one embodiment, latch 195 is built by drilling a hole down the center of a 1×1" block of wood, which serves as a guide 520 for dowel 525 (or other similar rod). More specifically, the hole serves as a sleeve for dowel 525 and is just wide enough for dowel 525 to slide freely. In this manner, dowel 525 is constrained to linear movement in a direction parallel to lid 510 and base 512 of box 104. (Alternatively, rather than a hole in guide 520 providing a sleeve that completely surrounds dowel 525, the guide may provide a groove, with dowel 525 constrained by the groove and a pin or the like which holds dowel 525 in the groove but allows linear movement along the groove. Accordingly, the hole shown in FIG. 5B may be considered a version of a groove that more completely surrounds dowel 525.)

A sturdy L-hook 515 (which may alternatively be a U-hook or eye-hook, is mounted into the box's base 512 so that it extends nearly to the inside surface of lid 510, which is opposite base 512 when closed. (More generally, hook 515 may comprise an arm that is fixed parallel to, and set away from, the surface on which it is mounted.) Dowel 525 is cut sufficiently long so that it engages hook 515 when deployed, i.e., extended by servo 190 to locked position 550. A tiny hole is drilled through dowel 525 near the proximate servo 190 so that it can be linked to servo arm 192 with a piece of rigid wire or paper clip, i.e., one of pins 535. The rest of latch assembly 195, i.e., other than hook 515 is then mounted into the lid 510.

Note, hook 515 may alternatively be mounted on inside surface of lid 510 with the rest of latch assembly 195 fixed to the opposing surface of base 512.

To summarize, for one embodiment, hook 515 of latch assembly 195 is secured to the inside surface of either lid 510 or base 512 and all the other components of latch assembly 195 are secured to the inside of the opposing inside surface, with freedom of lateral movement for dowel 525 enabled by guide 520. This permits dowel 525 to be driven laterally through a sleeve of guide 520 (which may alternatively be a grooved channel) by servo 190 via servo arm 192 and link 530, the servo 190 being controlled by controller 110, such that dowel 525 snags a hook 515 when engaged with closed lid 510. Thus with latch 195 engaged, hinges 540 and latch 195 keep lid 510 of box 104 tightly locked. In other embodiments, other latch mechanisms may be provided.

Figure 6:
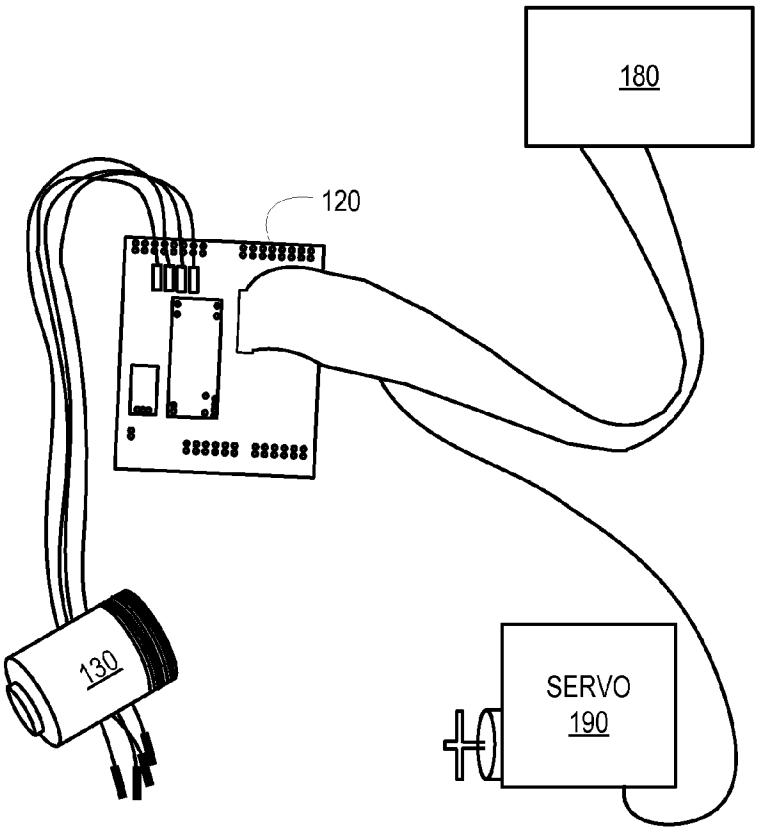
FIG. 6 illustrates a populated daughter board connected to a display module and a servo, and with wires for connecting to a pushbutton, all prior to installation in a box, according to an embodiment of the invention.
Figure 7:
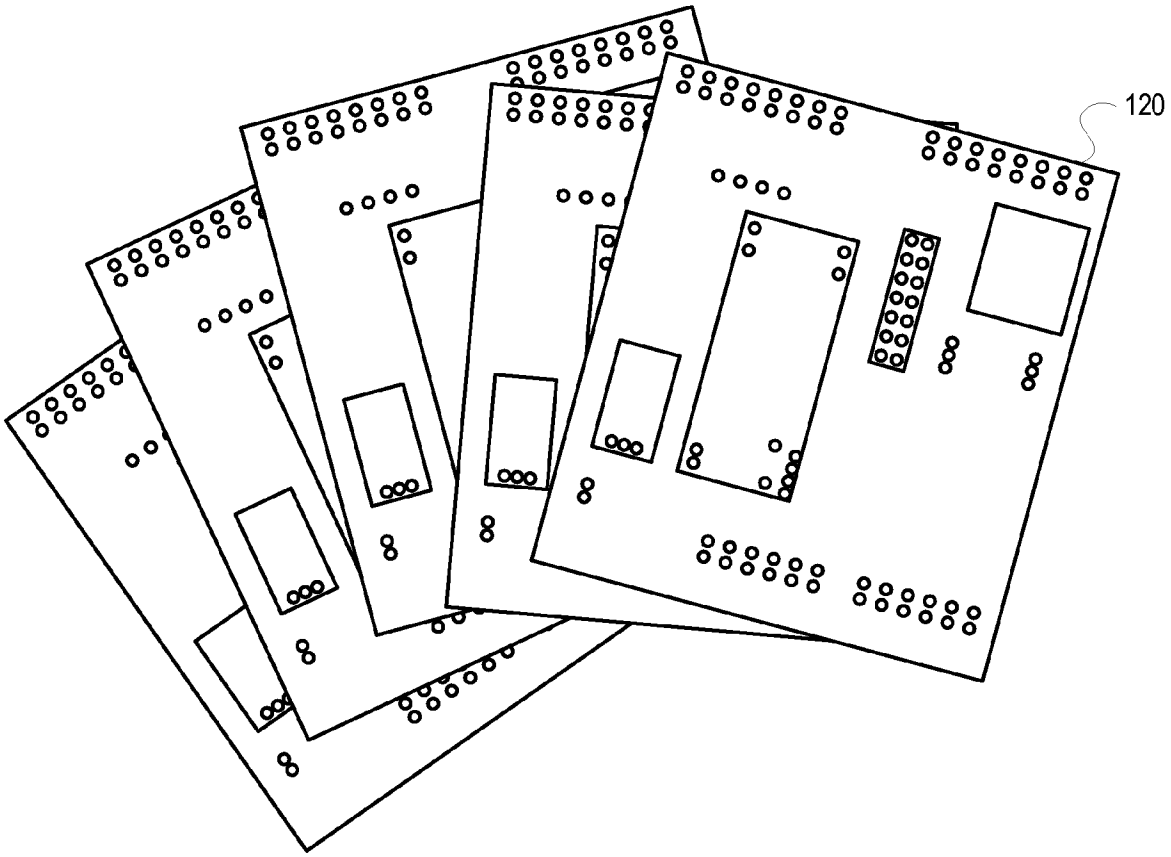
FIG. 7 illustrates a number of unpopulated daughter boards (also referred to as "shields") for use in systems, according to an embodiment of the invention.

Referring now to FIG. 6, a populated daughterboard 120, pushbutton 130, display module 180 and servo 190 are shown with wiring for connecting them to daughterboard 120, according to an embodiment. In FIG. 7 a close up is show of a number of unpopulated daughterboards 120.

From the forgoing it should be appreciated that an embodiment of the invention encompasses a method for providing a puzzle box. This method may include placing a gift for a user in a box having a lid for sealing the box and programming an electronic controller in the box. Further, the method may include configuring a motorized latch for locking the lid, wherein programming the electronic controller includes programming the controller with a predetermined geo-location and for driving the latch and a display. Also, the method may include configuring the controller to communicate with a GPS device located in the box for determining a geo-location of the system, wherein the controller programming further includes programming to cause the display to show distances to the predetermined geo-location in response to actuations of a pushbutton mounted on the box and responsive to respective current locations, and programming to disengage the latch If a distance indicated by the GPS device to the predetermined geo-location is less than a predetermined distance, revealing whatever gift has been placed inside the box.

Software

Controller 110 runs the Arduino version 0016 framework, in embodiments. Several native Arduino libraries are used, including Serial, Servo, and LiquidCrystal, which are disclosed herein, as well as several custom libraries, including TinyGPS, NewSoftSerial, PString, Streaming, and Flash, also disclosed herein.

In an embodiment, the controller 110 program includes box.pde, which is a "main" program and support routines; display.h/.cpp, which has routines and headers for formatting information to display 180; command.cpp, which has routines to support an internal command processor, allowing an attached computer to send commands via connector 115U reprogramming the target, etc.; and global.h, which provides global settings, pin assignments and variables. This program code and code for supporting libraries is set out in the enclosed Appendix.

Figure 2:
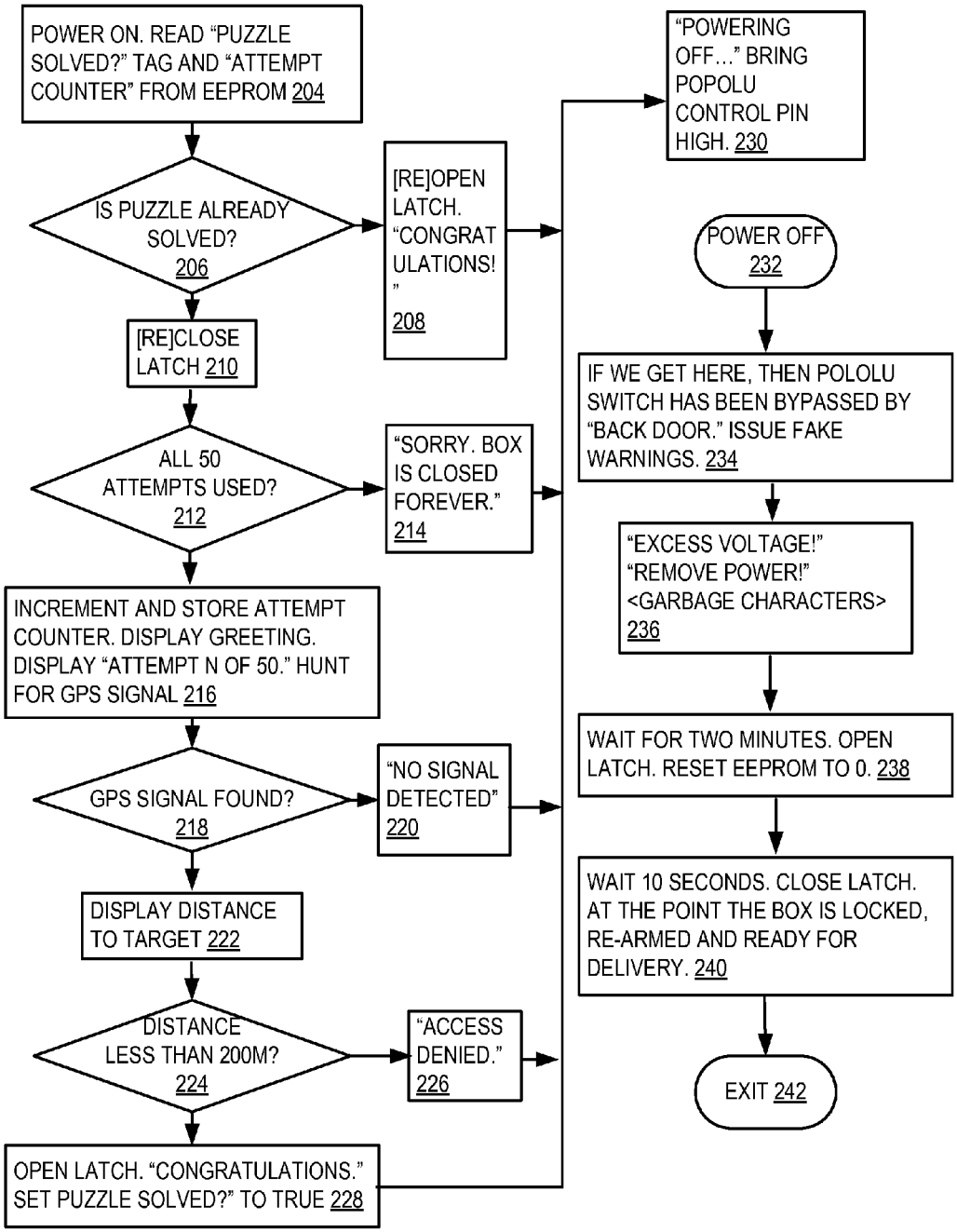
FIG. 2 is a flowchart for operation of a puzzle box system such as that of FIG. 1A, according to an embodiment of the invention.

Referring now to FIG. 2 in addition to FIG. 1A, aspects of the present invention are described in a flowchart, according to embodiments of the invention. At power up 204, which is responsive to actuation of pushbutton 130, as described herein above, controller 110 reads a puzzle solved tag and an attempt counter from EEPROM. If the tag indicates at 206 that the puzzle has been solved, then controller 110 proceeds at 208 to open latch 195 via servo 190 and to generate a "Congratulations" message for display 180. (Throughout this description of FIG. 2, the messages generated by controller 110 are communicated to display 180 for presentation to the user.) Then controller 110 proceeds to generate a "powering off" message at 230 and to power off at 232. If not, then, at 210, controller maintains latch 195 closed and proceeds to compare the value of attempt counter to a pre-programmed number of allowed attempts at 212, which is shown as 50 in the illustrated instance.

If the number of attempts has been exceeded, then controller 110 generates a message as indicated at 214, and then proceeds to generate a "powering off" message at 230 and to power off at 232. If not, controller 110 at 216 increments the attempt counter and generates a greeting message, such as shown at 216.

Also responsive to powering up of system 100, GPS module 170 hunts for a GPS signal and then determines its geo-location and generates position data which may be communicated to controller 110. (Module 170 receives from multiple satellites. In this parlance "getting a signal" means "the module has established sufficient communication with satellites to determine its position.")

Next, at 218, controller 110 communicates with GPS module 170 and determines if module 170 has found a GPS signal. If not, controller generates a not-found message, such as shown at 220, and then proceeds to generate a powering off message at 230 and to power off at 232. If the communication indicates the GPS signal has been found, then at 222 controller 110 reads the current location from GPS module 170, computes distance to a pre-programmed target location, and at then generates a current distance to target message. Herein above, the distance was described in terms of kilometers. In other embodiments, the distance to target may also be displayed in different units, such as English units, including miles or feet, or different metric units, including meters.

Next, at 224, controller 110 determines whether the current distance to the target is less than a pre-programmed margin, which is shown as 2000 km in the illustrated instance. If not, then at 226 controller 110 generates an access denied message and then proceeds to generate a powering off message at 230 and to power off at 232. If the current distance is less than the margin, then controller 110 proceeds at 228 to open latch 195 via servo 190 and to generate a "Congratulations" message. Also, controller 110 sets the puzzle solved tag to "true," then proceeds to generate a powering off message at 230 and to power off at 232.

In an embodiment, each time button 130 is actuated controller 110 records the current location and time in non-volatile memory for later use, publication or analysis. This may be done in connection with reaching blocks 208, 214, 220, 226 or 228. As previously mentioned, even if controller 110 has been powered completely off between actuations of button 130, it may obtain the current time by querying GPS module 170, since module 170 obtains a time indication from one or more remote satellites.

Why limit the number of attempts to 50, for example? At least two reasons. First, a puzzle is just more exciting if it is bounded. If it's fun to solve a Sudoku, how much more fun is it to try and do it in under ten minutes? Another reason is a practical one. Power consumption must be managed. How disappointing would it be if the batteries ran out and the puzzle was ruined? Constraining the number of attempts helps ensure that this won't be an issue. The number 50 has no special significance. A different number such as 25 or 20 works just as well.

Why the margin of error tolerance? There is always a little bit of error in a GPS reading, so some tolerance is necessary. If the target is an island that is about 4 kilometers across and the puzzle objective is to merely reach the island, setting the tolerance at 2000 meters forces the use to actually ferry across to the island without constraining them to any particular part. In another instance, controller 110 may be programmed with a target margin of error that is much smaller. For example, controller 110 may be initialized to a target location relatively nearby to the location at which system 100 is delivered to the user, such as 3000 meters away. Correspondingly, the target error margin may be 30 meters, for example.

"Back Door"

It may be risky for system 100 to be activated only a limited number of times before box 104 locks permanently. What happens if the user's four-year-old gets hold of it? What if batteries 140 unexpectedly run out? What if, despite due care and attention, there are still bugs in the implementation? Will the treasure inside be forever sealed? To address these concerns, embodiments provide a non-geo-location-based "back door," so to speak, for opening box 104, which includes connectors 115P and 115U or just connector 115U, in embodiments. Connector 115P or 115U is mounted on box 104 so as to be accessible to the user.

According to embodiments, a connector 115P, such as a 2.5 mm coaxial, or a USB connector 115U, is mounted through a side of box 104 and wired to controller 110, so that connector 115P or 115U is accessible to permit communication between an external device and controller 110 or to at least permit supplying external power to controller 110. The external device (FIG. 1B) may be a computer system 112 configured to program controller 110.

To make more certain that the user opens the box by solving the intended puzzle, operation of the back door means for opening box 104 may be withheld from the user. In an embodiment, if the user attempts to use the secret back door, system 100 may even provide misleading information to the user about operation of this means for opening box 104.

In an embodiment, a connector 115P (such as a 2.5 mm coaxial connector) is connected to controller 110 and mounted on box 104 accessible to the user, for supplying external power to the controller 110 or opening or resetting box 104. In another embodiment, connector 115U (such as a USB connector) is connected to controller 110 and mounted on box 104 accessible to the user, for configuring controller 110. In the former embodiment, circuitry 102 is configured such that responsive to application of current at externally accessible connector 115P, at a voltage of 5V, circuitry 102 will power up, just as if button 130 was activated. However, to cause this power up condition, connector 115P is wired to communicate this current directly to the controller 110, which bypasses switch module 160. Responsive to receiving this signal via connector 115P, controller 110 and GPS module 170 initially go through the above described routine of seeking a GPS signal and displaying accordingly. Thereafter, responsive to the signal via connector 115P controller 110 causes display 180 to indicate "Powering down," although controller 110 is actually not powering down. Instead, controller proceeds to count down for a pre-programmed delay time, such as a two-minute delay, as long as the user maintains the voltage at connector 115P. At the end of the delay time, if the user has maintained voltage at connector 115P for the entire delay time, controller 110 causes servo 190 to open latch 195, regardless of where box 104 and its circuitry 102 are actually located. This back door access enables one more chance to replace batteries 140 or repair any design flaw on an emergency basis.

In one or more embodiments, controller 110 is also programmed to cause alarming messages during the delay time to further dissuade the user from maintaining the voltage on connector 115P and thereby discovering the back door access secret. Remember, the user does not know how to use the "back door" or what voltage and current to apply. However, after controller 110 initially causing the "Powering down" message responsive to voltage on connector 115P, next responsive to continued power on connector 115P controller 110 further misdirects the user by causing display 180 to next flash a fake warning:

"Excess Voltage!
Remove Power!"

Figure 3:
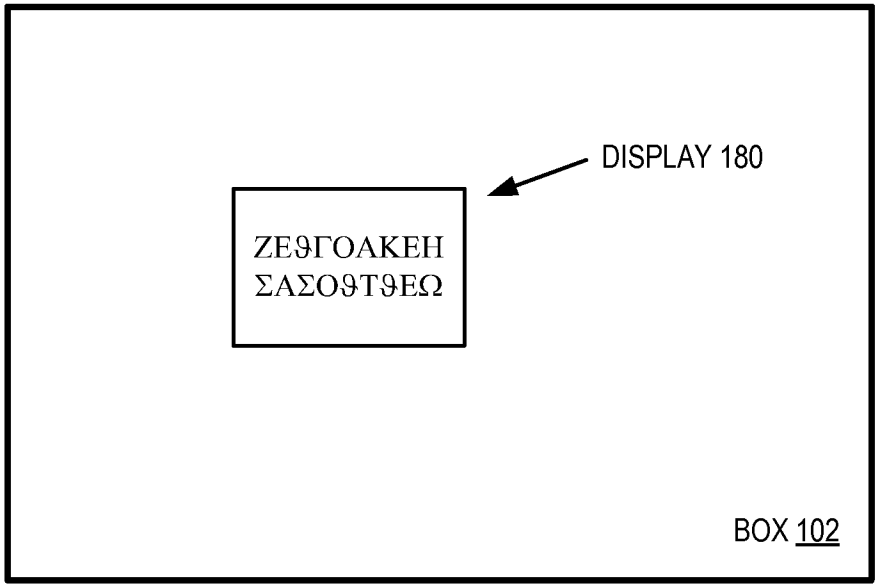
FIG. 3 illustrates displaying unintelligible characters, according to an embodiment of the invention.

If this still is not discouraging enough, the user will be further misdirected by controller 110 next causing display 180 to flash a blast of random unintelligible characters, such as shown in FIG. 3, suggesting that a critical failure is underway. To open box 104 by the "back door," the user will be subjected to display of these ominous messages for the full delay time, such as a full two minutes.

In other embodiments, in which connector 115U is configured for external access, controller 110 is programmed to require communication of a password via connector 115U in order to permit the above described "back door" operation. In these embodiments in which 115U is externally accessible, controller 110 may optionally not be programmed to include the above described alarming messages.

Referring once again to FIG. 2 along with FIG. 1A, back door operation is illustrated, according to an embodiment in which a connector 115P (such as a 2.5 mm coaxial connector) is connected to controller 110 for opening box 104 and mounted on box 104 accessible to the user and another connector 115U (such as a USB connector) is also connected to controller 110 for programming controller 110. Responsive to receiving a voltage signal via connector 115P at 234, controller 110 generates a "Powering down" message, although controller 110 is actually not powering down. Then, controller 110 generates alarming messages at 236. Meanwhile, at 238 controller counts down for a pre-programmed delay time, such as a two-minute delay, as long as the user maintains the voltage at connector 115P. At the end of the delay time, if the user has maintained voltage at connector 115P for the entire delay time, at 238 controller 110 causes servo 190 to open latch 195, regardless of where box 104 and its circuitry 102 are actually located. Also at 238 controller 110 resets the attempt counter and puzzle solved tag in EEPROM.

At this point, i.e., block 238 in flowchart 200, the owner of system 100, or any user who has rather complete operating instructions, may remove power and repair anything that is broken, replace batteries 140, reprogram controller 110 with a new target location, etc.

If power is not removed at 238 by the end of the pre-programmed delay time, such as a two-minute delay, then after 10 more seconds, at 240, controller 110 causes latch 195 to lock once again. This feature provides a way to "reset" system 100 back to a "closed and armed" state, wherein operation at 204 will resume responsive to the next actuation of pushbutton 130. That is, after performing repairs or reprogramming (which was upon having unlocked box 104 at 238), the user closes the lid to box 104 and re-applies power to connector 115P. Responsive to re-application of power on connector 115P, controller again begins operation at 204. After again reaching 240 (by applying power at connector 115P continuously for the two minute delay plus the 10 second delay), system 100 is now re-armed and controller 110 will proceed to block 204 upon switch 160 detecting actuation of pushbutton 130.

Referring now to FIG. 1B, in an embodiment, computer software is provided in a computer 112 that is external to box 104 (also referred to herein as a "remote" computer) and that is connected to controller 110 via USB connector 115U. This software is configured to program, configure, or control the controller 110 and/or other components of the system 100 via USB connector 115U, which is coupled via circuitry 110U2S (FIG. 1B) to microprocessor 110MP (FIG. 1B). Examples of such programming, configuring, or controlling include the following, according to an embodiment:

adjust a "sensitivity radius" of the circle in which the latch 195 will open;

set the maximum number of button 130 activations allowed before the box locks permanently;

open or close the latching mechanism 195;

calibrate the servo arm 192;

set a new destination at which the latch 195 will open;

reset the controller 110 to its default settings;

enable or disable a debugging facility;

perform diagnostic tests on the controller's 110 onboard EEPROM;

constrain the time and/or date range during which the box 104 can be opened;

modify the controller's 110 secret login password;

reset the controller's 110 "number of attempts" counter to 0 or any other value;

configure whether the display shows English or metric units; and create a personalized greeting to the user (also referred to as "custodian"), which is displayed responsive to initial actuation of pushbutton 130.

Code for controller 110 that enables commands for this configuring, according to an embodiment, includes the ProcessCommand( ) function inside command.cpp, which is disclosed herein in the Appendix. For example, else if (FLASH("lock")==buf)

handles the command to lock or unlock box 104 under computer control.

The external computer may communicate with controller 110 using ordinary serial terminal emulation software on the external computer or may use RG-console.cpp, computer software which is also disclosed herein in the Appendix. In various embodiments, the computer software might be written in C++, Java or any other computer programming language, and the controller may be any computer system.

In an embodiment, remote computer 112 software is configured to enable the remote computer to extract historic data ("quest" data) and publish it to a digital target 114, such as the World Wide Web or a social networking site. This remote computer 112 software may help the owner publish a human narrative by reading the records of location and time from non-volatile memory of controller 110, which were accumulated each time button 130 was actuated, and by reading the programmed target location. The remote computer software may also help the owner publish the narrative by uploading this data to the digital target 114, and may also receive user input about the story of the building of the box (if applicable), what was placed inside and human interest facts about what happened on the quest, which the software also uploads.

Other Variations:

1. Direction instead of distance: . . . the display reveals the vector (angle/course) to the special location . . .
2. Multistage: . . . the display reveals the distance to the first of N waypoints that must be visited before the internal latch . . .
3. Time constrained: . . . the display reveals the distance to the special location and a specific time window where and when the internal latch . . .
4. Nesting: . . . where the internal latch automatically opens, revealing a smaller box that must also be solved.
5. Multiplayer: . . . where the internal latch automatically opens, but only if it detects the nearby presence of a second box, operated by another custodian.
6. Intense/compressed: . . . up to a maximum of 5 times . . . (or some configurable number less than 50)
7. In addition to location and time there are a number of other physical parameters using various hardware sensors that could constrain the opening of the box. The puzzle solving experience provided by system 100 can verge on that of an extreme sport by use of sensors and programming that yield extreme parameters such as the following:

a. Temperature—box 104 must be over 110 degrees to open. Thus, a thermal sensing device, such as a one-wire sensor, is used in an embodiment to provide an input to controller 110. In this case, controller 110 is accordingly programmed to only activate servo 190 to open latch 195 responsive to the sensor indicating a temperature above 30 C, for example.

b. Velocity—box 104 must be traveling at 90 mph c. Vector—box 104 must be traveling 90 mph due north d. Orientation—box 104 must be oriented towards Mecca e. Acceleration—box 104 must be falling at 1 G for 3 seconds f. Altitude—box 104 must be at 30,000 feet 8. Other time-based constraints: for example, user has 90 minutes from the time of first pressing button 130 to solve puzzle and thereby open box 104.

Chirrup

When the GPS module finally detects a good signal, controller 110 "chirrups" the servo motor as a pleasant little bit of audio/tactile feedback. This suggests to the custodian that something has happened, as indeed it has. Controller 110 does this by very quickly moving the latch 10 degrees towards the "open" position, but then immediately back to the "closed" position. It's not enough to risk opening the box, but it does provide some nice feedback.

Blink

Controller 110 causes a blue LED surrounding button 130 to blink while box 104 is in the "seeking signal" state. Once the signal is found, controller 110 causes the LED to glow serenely and continuously. More positive feedback.

Delay

Many programs use delays. For example, you may draw a message on a display, delay for 3 seconds to give the user a chance to read it, then draw a new message. Arduino even has a built-in function called "delay" just for this purpose. The problem is, while delaying, incoming data may be lost, which in the present case may include data from GPS module 170 or programming data from an attached computer. Accordingly, in an embodiment, controller 110 is programmed with a "smart" delay function called "ActiveDelay" that behaves like "delay" but handles all this incoming data in the background.

Adventure Gift/Message

An embodiment includes a virtual-box-in-a-cell-phone, one variation of which is a sort of game between two players, according to an embodiment. One person sends another an electronic message enclosed in a virtual envelope sealed with a location seal and (optionally) a time window. The note may contain something of value, like an electronic gift certificate, or it may be just a note. The recipient cannot read the contents until he/she travels to the specified destination during the specified time window (if any). The recipient is not told where the location is. The recipient only knows:

1. How far they are from the location
2. How close they have to be for the envelope to open.
3. The time window during which the envelope can be opened (if applicable).
4. The identity of the sender When the recipient receives the message, he/she may refuse it (because he doesn't like the sender, doesn't want to play, or doesn't think he can make it to the destination in time). If he accepts, his phone's screen displays his distance and the time. If he/she arrives at the location within the prescribed time, the envelope opens. The sender is apprised whenever the game changes state. Possible states are: active, declined, success, or fail.

Sample Use Cases:

Message: an electronic gift card to retailer X. Location: Retailer X's store in recipient's town. Timestamp: business hours.

Message: "Hi, let's do lunch: I'm buying". Location: a favorite restaurant. Timestamp: between 12:00 and 12:15 next Tuesday.

Message: "Happy anniversary. This is the land I bought for our new house." Location: The land. Timestamp: none.

Message: "Go inside and ask for Mr. Murphy. Tell him your name". Location: Mr. Murphy's car dealership. He has the keys to your new car. Timestamp: During Murphy's business hours.

Message: "Look for a metal box in the bushes next to the Sycamore tree." Location: A place where the sender has hidden something. Timestamp: none.

Multiplayer Adventure Game

This is a multiplayer race, according to another variation of a virtual-box-in-a-cell-phone embodiment. One person, the "game master", creates a game. A game is a collection of one or more physical locations that must be visited by the players. The master is not a player. A game has a designated starting time. One or more players are invited to play by the master, or perhaps the invitation is public.

Before the game starting time, the players are told how many destinations there are and roughly where they are. For example: "8 destinations within 15 miles of Llano, Texas". They are not told specifically where the locations are.

When the game starts, the players are given the following information:

1. For each location: how far away they currently are, or if it has already been visited. This data is continuously updated as the game progresses.
2. How many other people are playing and what their statuses are, i.e. how many destinations each have completed.

The winner is the player who discovers and visits all the locations first, or perhaps all players who complete the race are winners. The game is intentionally vague on this or what prize is awarded to the winners beyond the frame of having won.

The master, the players, and (optionally) the public may follow the race on the web. The race website shows the current "standings" for games in progress and a map showing the most recent known locations of all the players.

Herein above embodiments are described in which information is presented on the display that is mounted on the box lid. In another embodiment, a wireless adapter is included in box 104 and wired to controller 110 so that controller 110 may communicate via a wireless link to computer 112. In this manner some or all of this information may be also sent (or sent in the alternative) from controller 110 via a wireless link to an external device, such as to a computer on a network or a cell phone, or any other device capable of representing data, which may be anything from a single LED up to a computer system display. Likewise, herein above embodiments are described in which controller 110 is programmed by wiring to computer 112 via connector 115U. In another embodiment, some or all of this programming may be by the above described wireless link to computer 112.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

Furthermore, aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

In the context of this document, a computer readable storage medium may be any tangible medium that can contain, or store a program for use by or in connection with an instruction execution system, apparatus, or device. A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be supplied to a processor of a general purpose computer, special purpose computer, or other programmable data processing apparatus, such that the processor and instructions provide a machine that implements functions and actions specified in the one or more flowchart or block diagram herein. The processor of a general purpose computer, special purpose computer, or other programmable data processing apparatus may be referred to herein as a "microprocessor." However, the term "microprocessor" should not be interpreted as being limited to a single-chip processing unit, unless explicitly so stated.

These computer program instructions may also be stored in a computer readable medium that can direct a computer, other programmable data processing apparatus, or other devices to function in a particular manner, such that the instructions stored in the computer readable medium produce an article of manufacture including instructions which implement any function or action specified in the one or more flowchart or block diagram herein. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing any function or action specified in the one or more flowchart or block diagram herein.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Reference throughout this specification to "one embodiment," "embodiments," or similar language means that a particular feature, structure, or characteristic described in connection with the embodiments is included in at least one embodiment of the present invention. Thus, appearances of the phrases "in one embodiment," "in an embodiment," "embodiments," and similar language throughout this specification may, but do not necessarily, all refer to the same embodiment. Furthermore, the described features, structures, aspects, and/or characteristics of the invention may be combined in any suitable manner in one or more embodiments. Correspondingly, even if features may be initially claimed as acting in certain combinations, one or more features from a claimed combination can in some cases be excised from the combination, and the claimed combination can be directed to a sub-combination or variation of a sub-combination.

In the descriptions herein, numerous specific details are provided, such as examples of programming, software modules, user selections, network transactions, database queries, database structures, hardware modules, hardware circuits, hardware chips, controllers, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations may be not shown or described in detail to avoid obscuring aspects of the invention.

As used herein, the terms "comprises," "comprising," or any other variation thereof, may be intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as essential or critical.

Benefits, advantages and solutions to problems have been described above with regard to specific embodiments. However, the benefits, advantages, solutions to problems, and any element(s) that may cause any benefit, advantage, or solution to occur or become more pronounced may be not to be construed as critical, required, or essential features or elements of any or all the claims.

Those skilled in the art having read this disclosure will recognize that changes and modifications may be made to the embodiments without departing from the scope of the present invention. It should be appreciated that the particular implementations shown and described herein may be illustrative of the invention and its best mode and may be not intended to otherwise limit the scope of the present invention in any way. Other variations may be within the scope of the following claims.

While this specification contains many specifics, these should not be construed as limitations on the scope of the invention or of what can be claimed, but rather as descriptions of features specific to particular implementations of the invention. Headings herein may be not intended to limit the invention, embodiments of the invention or other matter disclosed under the headings.

What is claimed is:

1. A method comprising:

receiving, by a user, a physical object locked inside a box and having a predetermined association with the user;

sending, by an electronic controller, an unlock signal to a latch operator of the box, the unlock signal causing the latch operator to unlock the box, allowing the box to be opened to reveal the physical object inside the box;

reading, by the electronic controller, instances of current geo-location of the box and date from a GPS device;

determining, by the electronic controller for respective instances of actuation of an input device, respective current distances from the respective current geo-locations to a target geo-location stored in a memory for the electronic controller, the target geo-location having a predetermined association with the user and a predetermined association with the physical object;

presenting a message indicating where the box will unlock in response to the input device actuations, wherein the electronic controller does NOT send the unlock signal to the latch operator responsive to the input device actuation when a current distance is greater than a predetermined threshold distance;

sending the unlock signal to the latch operator for unlocking the box to reveal the physical object inside the box responsive to actuation of the input device when the current distance is NOT greater than the predetermined threshold distance;

powering the electronic controller and said GPS device by a battery;

storing in the memory each instance of the current geo-location and date read from the GPS device; and shutting down the electronic controller and GPS device a predetermined time after actuation of the input device, such that a date for each instance of input device actuation is captured in the memory without maintaining continuous operation of a clock and charge of the battery is preserved, thereby extending a period during which the electronic controller and GPS device are used for intermittently attempting to find the target geo-location while concurrently enabling the storing of geo-location, and date for instances of an attempt to reveal the physical object inside the box by actuating the input device at a geo-location that is potentially the target geo-location.

2. The method of claim 1, wherein the message includes the current distance from the current geo-location to the target geo-location.

3. The method of claim 1, wherein the message includes a description of a previous experience of the user and of how that experience indicates the target geo-location.

4. The method of claim 1, comprising counting, by the electronic controller, how many times the input device is actuated and storing the count in a memory, wherein the electronic controller does NOT send the unlock signal to the latch operator responsive to the input device actuation when the count of how many times the input device has been actuated exceeds a predetermined limit.

5. The method of claim 1, wherein the electronic controller does NOT send the unlock signal to the latch operator responsive to the input device actuation when a current date is before a predetermined date.

6. The method of claim 1, wherein the date includes the time of day.

7. A system comprising:

a box having first and second portions, wherein the box has an exterior and the first and second portions form an interior space of the box for holding contents therein;

a latch configured for locking the box by engaging certain parts of the latch to lock first and second portions of the box together to lock the contents in the box's interior space;

an output device for presenting a message indicating where the box will unlock;

an input device accessible for user actuation from the exterior of the box;

an electronic controller, the controller comprising a processor having a memory and a clock, wherein the electronic controller is configured with instructions in the memory to drive the output device for presenting the message;

an operator, wherein the electronic controller is being configured to send lock and unlock signals for controlling the operator, and wherein the operator is configured to operate the latch responsive to the lock and unlock signals, and wherein the electronic controller is further configured to send the lock signal, thereby causing the latch to engage the certain parts of the latch to lock the box, responsive to the electronic controller being initialized and is configured to send the unlock signal, thereby causing the latch to disengage the certain parts of the latch, responsive to the electronic controller receiving a signal caused by actuation of the input device, such that disengaging the certain parts of the latch unlocks the box, allowing the first and second parts of the box to be opened to reveal the contents of the box's interior;

a GPS device configured for determining a geo-location of the box, wherein the electronic controller is further configured to receive communication indicating a current geo-location of the box determined by the GPS device, wherein the electronic controller is further configured to determine a current distance from the received, current geo-location to a target geo-location, wherein the electronic controller driving the output device includes the electronic controller causing the output device to present the message in response to the electronic controller receiving the signal caused by actuation of the input device, and wherein the electronic controller is further configured to NOT send the unlock signal if the current distance is greater than a predetermined threshold distance; and a battery for powering the electronic controller, GPS device and output device, wherein the electronic controller is further configured to cause the processor to read from the GPS device responsive to instances of actuation of the input device, the current geo-location and date, and is configured to store in the memory each instance of the current geo-location and date read from the GPS device, and wherein the electronic controller is further configured to cause the processor, including the clock, to shut down a predetermined time after actuation of the input device, such that a date for each instance of input device actuation is captured without maintaining continuous operation of the clock, so that the shutting down of the processor preserves charge of the battery, thereby extending a period during which the system is used for intermittently attempting to find the target geo-location while concurrently enabling capturing and preserving of geo-location and date for each instance of an attempt to reveal the contents of the box's interior by finding the target geo-location.

8. The system of claim 7, wherein the message includes the current distance from the current geo-location to the target geo-location.

9. The system of claim 7, wherein the message includes a description of a previous experience of the user and of how that experience indicates the target geo-location.

10. The system of claim 7, wherein the electronic controller is further configured to count how many times the input device is actuated and store the count in a memory, wherein the electronic controller does NOT send the unlock signal to the latch operator responsive to the input device actuation when the count of how many times the input device has been actuated exceeds a predetermined limit.

11. The system of claim 7, wherein the electronic controller does NOT send the unlock signal to the latch operator responsive to the input device actuation when a current date is before a predetermined date.

12. The system of claim 7, wherein the date includes the time of day.

13. The system of claim 7, wherein the input device includes a pushbutton.

14. A non-transitory computer readable storage medium having program code stored thereon, the computer readable storage medium comprising:

program code for configuring an electronic controller with a target geo-location;

program code for initializing the electronic controller;

program code for sending a lock signal to a latch operator of a box responsive to the initializing of the electronic controller, wherein the lock signal causes the latch operator to lock a physical object inside the box for a user;

program code for detecting actuation of an input device of the box;

program code for reading instances of current geo-location of the box and date from a GPS device;

program code for determining, for respective instances of actuation of the input device, respective current distances from the respective current geo-locations to the target geo-location;

program code for presenting a message to the user indicating when the box will unlock in response to the input device actuations;

program code for sending an unlock signal to the latch operator responsive to detecting the actuation of the input device and for preempting the sending of the unlock signal when a current distance is greater than a predetermined threshold distance, wherein the unlock signal causes the latch operator to unlock the box, allowing the box to be opened to reveal the physical object inside the box;

program code for storing in the memory instances of the current geo-location and date read from the GPS device, wherein the electronic controller and GPS device are powered by a battery; and program code for shutting down the electronic controller and GPS device a predetermined time after actuation of the input device, such that a date for respective instances of input device actuation is stored in the memory without maintaining continuous operation of a clock and such that charge of the battery is preserved, thereby enabling the storing of geo-location and date while concurrently extending a period during which the electronic controller and GPS device are used for instances of an attempt to reveal the physical object inside the box by actuating the input device at a geo-location that is potentially the target geo-location.

15. The computer readable storage medium of claim 14, wherein the message includes the current distance from the current geo-location to the target geo-location.

16. The computer readable storage medium of claim 14 wherein the message includes a description of a previous experience of the user and of how that experience indicates the target geo-location.

17. The computer readable storage medium of claim 14, wherein the program code includes program code for counting how many times the input device is actuated and storing the count in a memory, wherein the electronic controller does NOT send the unlock signal to the latch operator responsive to the input device actuation when the count of how many times the input device has been actuated exceeds a predetermined limit.

18. The computer readable storage medium of claim 14, wherein the electronic controller does NOT send the unlock signal to the latch operator responsive to the input device actuation when a current date is before a predetermined date.

19. The computer readable storage medium of claim 14, wherein the date includes the time of day.

20. The computer readable storage medium of claim 14, wherein the program code for detecting actuation of an input device of the box includes program code for detecting actuation of a pushbutton.

* * * * *